US005618634A

United States Patent [19]

Hosoda et al.

[11] Patent Number: 5,618,634

[45] Date of Patent: Apr. 8, 1997

[54] COMPOSITE ZINC- OR ZINC ALLOY-ELECTROPLATED METAL SHEET AND METHOD FOR THE PRODUCTION THEREOF

[75] Inventors: Yasushi Hosoda, Amagasaki; Masanari Kimoto, Kobe; Shinya Hikino, Wakayama; Tsutomu Yoshida, Amagasaki; Kiyoyuki Fukui, Kobe, all of Japan

[73] Assignee: Sumitomo Metal Industries, Ltd., Osaka, Japan

[21] Appl. No.: 264,291

[22] Filed: Jun. 23, 1994

[30] Foreign Application Priority Data

Jun. 23, 1993 [JP] Japan ..... 5-176191
Jul. 6, 1993 [JP] Japan ..... 5-167094

[51] Int. Cl.[6] ..... B32B 15/18; B32B 15/08; C25D 3/22

[52] U.S. Cl. ..... 428/610; 428/623; 428/626; 428/634; 428/658; 428/659; 205/104; 205/311; 205/312

[58] Field of Search ..... 428/658, 659, 428/935, 639, 632, 626, 623, 610, 634; 205/311, 312, 313, 314, 245, 246, 109, 104

[56] References Cited

U.S. PATENT DOCUMENTS

| | | | |
|---|---|---|---|
| 3,672,971 | 6/1972 | Senge et al. | 205/314 |
| 3,778,359 | 12/1973 | Popescu | 205/314 |
| 3,960,677 | 6/1976 | Hildering et al. | 205/311 |
| 4,071,419 | 1/1978 | James | 205/314 |
| 4,251,331 | 2/1981 | Rosenberg | 205/314 |
| 4,411,742 | 10/1983 | Donakowski et al. | 204/16 |
| 4,797,183 | 1/1989 | Yamamoto et al. | 205/311 |
| 4,889,602 | 12/1989 | Oshima et al. | 205/245 |
| 5,242,572 | 9/1993 | Shindou et al. | 205/245 |

*Primary Examiner*—John Zimmerman
*Attorney, Agent, or Firm*—Burns, Doane, Swecker & Mathis, LLP

[57] ABSTRACT

A zinc or zinc alloy electroplated metal sheet comprises a metal sheet having, on at least one surface thereof, a composite zinc or zinc alloy plated coating formed by electroplating with zinc or a zinc alloy in a plating solution which contains at least one organic compound selected from the group consisting of alkynes, alkynols, amines and salts thereof, thio compounds, heterocyclic compounds, and aromatic carboxylic acids and salts thereof. The composite plated coating has a coating weight of 0.5–200 g/m$^2$ and contains 0.001–10 wt % of co-deposited carbon. The electroplated metal sheet has improved post-painting corrosion resistance, press formability, and spot weldability.

24 Claims, 1 Drawing Sheet

COMPOSITE ZINC- OR ZINC ALLOY-ELECTROPLATED METAL SHEET AND METHOD FOR THE PRODUCTION THEREOF

BACKGROUND OF THE INVENTION

This invention relates to a composite zinc- or zinc alloy-plated metal sheet which has good press formability and good bare (as-plated) and post-painting corrosion resistance as well as a remarkably improved spot; weldability and which can be improved in low-temperature impact resistance. This invention also relates to a method for the production of such a plated metal sheet. The composite zinc- or zinc alloy-plated metal sheet is suitable for use in automobiles, electric appliances, and building materials.

Surface-treated steel sheets are used in various applications including automobiles, electric appliances, and building materials. In particular, the use of rust-preventing steel sheets having a rust preventive surface coating formed thereon has been promoted in automobiles, particularly in automobile panels, to be sold in cold regions, in which they are exposed to a severe corrosive environment due to the use of rock salt on roads in order to prevent freezing. As rust-preventing steel sheets are used in an increased quantity, requirements therefor with respect to rust preventing properties have become increasingly strict. For example, such steel sheets are required to have a long-term corrosion resistance intended to resist perforative corrosion for 10 years and surface rusting for 5 years.

In addition to corrosion resistance, rust-preventing steel sheets are required to have press formability capable of withstanding severe press forming such as deep drawing, and spot weldability enabling bonding by resistance spot welding, which is widely employed, particularly by continuous spot welding with an increased number of weld spots. They are also desired to have post-painting corrosion resistance, i.e., the capability of forming a painted film having good adhesion in a painting step subsequent to a press forming step such that they exhibit corrosion resistance in areas where the painted film is injured and in edge faces. Furthermore, it is desired that rust-preventing steel sheets for use in outer panels of automobiles to be sold in cold regions have cold temperature impact resistance good enough to prevent the adhesion of the rust-preventive surface coating from being damaged by an impact, e.g., caused by hitting a pebble thereon in a low-temperature region (−50° C. to 0° C.).

The most popular rust-preventing steel sheets are zinc-plated steel sheets prepared by electroplating or hot dipping (galvanizing) with zinc metal. However, zinc-plated steel sheets do not have an adequate long-term corrosion resistance unless the zinc coating has a large thickness. Such a thick zinc coating not only tends to cause seizure with a die in press forming, thereby adversely affecting the press formability, but also results in deterioration in spot weldability due to accelerated damage of electrodes In a spot welder caused by diffusion of zinc into the electrodes.

In order to eliminate one or more of these disadvantages, a variety of zinc alloy-plated steel sheets have been proposed. These have a coating of a zinc alloy with one or more metals such as Fe, Co, Mn, Cr, Al, or the like. Some of these sheets such as those having a Zn-Ni or Zn-Fe alloy coating, have already been used in practical applications.

Zinc alloy-plated steel sheets generally have improved as-plated corrosion resistance to perforation and can protect the substrate steel sheet with a relatively thin coating. However, their press formability and spot weldability are still less than satisfactory. Furthermore, some zinc alloy coatings tend to be readily stripped off due to powdering during press forming, thereby deteriorating the press formability and corrosion resistance. Zinc alloy-plated steel sheets also suffer from an unstable post-painting corrosion resistance and a deteriorated low-temperature impact resistance.

In the following description, the term "zinc-base plating" is used to include both zinc plating and zinc alloy plating. Similarly, the term "zinc-base plated" steel sheet or metal sheet encompasses both a steel or metal sheet having a zinc plated coating or a zinc alloy plated coating.

For further improvement of zinc-base plated steel sheets, multilayer zinc-base plated steel sheets which have a lower zinc-base plated layer and one or more upper coating layers have been proposed.

Japanese Patent Application Laid-Open (Kokai) No. 60-215789 (1985) describes a duplex plated steel sheet having a lower zinc plated coating at a weight of 10–300 $g/m^2$ and an upper zinc alloy plated coating at a weight of 1–20 $g/m^2$ which contains one or both of Ni and Co in a total amount of 15–30 wt %.

Japanese Patent Publication (Kokoku) No. 58-15554(1983) describes a duplex plated steel sheet having good applicability to chemical conversion treatment and electrodeposition, thereby exhibiting good post-painting corrosion resistance. The duplex plated steel sheet comprises an alloyed galvanized steel sheet having a thin Fe-based coating formed thereon by flash plating.

Japanese Patent Application Laid-Open (Kokai) No. 1-172578(1989) describes a duplex plated steel sheet comprising an alloyed galvanized steel sheet having thereon a layer of an anhydrous alkali metal salt of an oxide of a metalloid such as boron or phosphorus.

Even in these multilayer zinc-base plated steel sheets, the corrosion resistance basically depends on the lower zinc-base plated coating. Therefore, in order to achieve good corrosion resistance desired by users, the lower zinc-base plated layer must be a thick coating, thereby adversely affecting the press formability and spot weldability.

It is known that a composite organic-inorganic coated steel sheet comprising a zinc-base plated steel sheet having thereon a chromate film and a thin organic resin coating has a remarkably improved corrosion resistance due to an anti-corrosive effect of the chromate film and a function of the resin coating as a barrier shielding from a corrosive environment. However, such a composite coated steel sheet does not have a satisfactory post-painting corrosion resistance since the barrier function of the resin coating is lost in injured areas and edge faces.

Accordingly, there remains a need for a surface treated steel sheet having various properties required for automobile panels, i.e., press formability and spot weldability good enough for assembly while maintaining high corrosion resistance, as well as good low-temperature impact resistance and applicability to painting so as to give improved post-painting corrosion resistance.

SUMMARY OF THE INVENTION

It is an object of this invention to provide a surface treated metal sheet having good corrosion resistance, press formability, and post-painting corrosion resistance, and improved spot weldability, particularly in continuous resistance spot welding.

A more specific object of this invention is to provide a zinc-base plated metal sheet having improved press formability, post-painting corrosion resistance, and spot weldability while maintaining good bare (as-plated) corrosion resistance, even if the sheet has a single plated coating or a thick plated coating.

Another object of this invention is to provide such a zinc-base plated metal sheet which is improved in low-temperature impact resistance, in addition to the above-described properties.

A further object of this invention is to provide a method for producing the above-described zinc-base plated steel sheet.

A still further object of this invention is to provide a composite organic-inorganic coated metal sheet having improved press formability, post-painting corrosion resistance, and spot weldability.

These and other objects can be achieved by a composite zinc or zinc alloy electroplated metal sheet comprising a metal sheet having, on at least one surface thereof, a composite zinc or zinc alloy plated coating formed by electroplating with zinc or a zinc alloy in a plating solution which contains at least one organic compound selected from the group consisting of alkynes, alkynols, amines and salts thereof, thio compounds, heterocyclic compounds, and aromatic carboxylic acids and salts thereof in an amount in the range of 0.001–10 wt %, the composite plated coating having a coating weight of 0.5–200 g/m$^2$ and containing 0.001–10 wt % of co-deposited carbon.

In one embodiment, the metal sheet is a steel sheet and the composite plated coating has a weight of 5–200 g/m$^2$. In another embodiment, the metal sheet is a plated steel sheet having a plated coating selected from the group consisting of a zinc coating, an aluminum coating, and a zinc or aluminum alloy coating, on which the composite plated coating is formed with a weight of 0.5–20 g/m$^2$.

This invention also provides a composite organic-inorganic coated metal sheet comprising the composite zinc or zinc alloy electroplated metal sheet described above, a chromate film formed at a weight of 10–200 mg/m$^2$ as Cr on the composite zinc or zinc alloy plated coating of the metal sheet, and an organic resin coating formed with a thickness of 0.1–2 μm on the chromate film.

In another aspect, the present invention is a composite zinc alloy electroplated metal sheet comprising a metal sheet having, on at least one surface thereof, a composite zinc alloy plated coating having a coating weight of 0.5–200 g/m$^2$ and containing 0.001–10 wt % of co-deposited carbon and at least 0.2 wt % in total of one or more alloying metal elements, wherein the composite zinc alloy plated coating has a carbon-rich surface layer with a thickness of 0.1–10 μm, the thickness constituting from 5% to 50% of the thickness of the plated coating.

In a still another aspect, the present invention is a composite zinc alloy electroplated metal sheet comprising a metal sheet having, on at least one surface thereof, a composite zinc alloy plated coating having a coating weight of 0.5–200 g/m$^2$ and containing 0.001–10 wt % of co-deposited carbon and 0.2–10 wt % in total of one or more alloying metal elements, wherein the η phase present in the composite zinc alloy plated coating has an orientation index of not greater than 0.8 for the (00·2) plane and not less than 0.2 for the (10·1) plane.

DETAILED DESCRIPTION OF THE INVENTION

Figure 1:
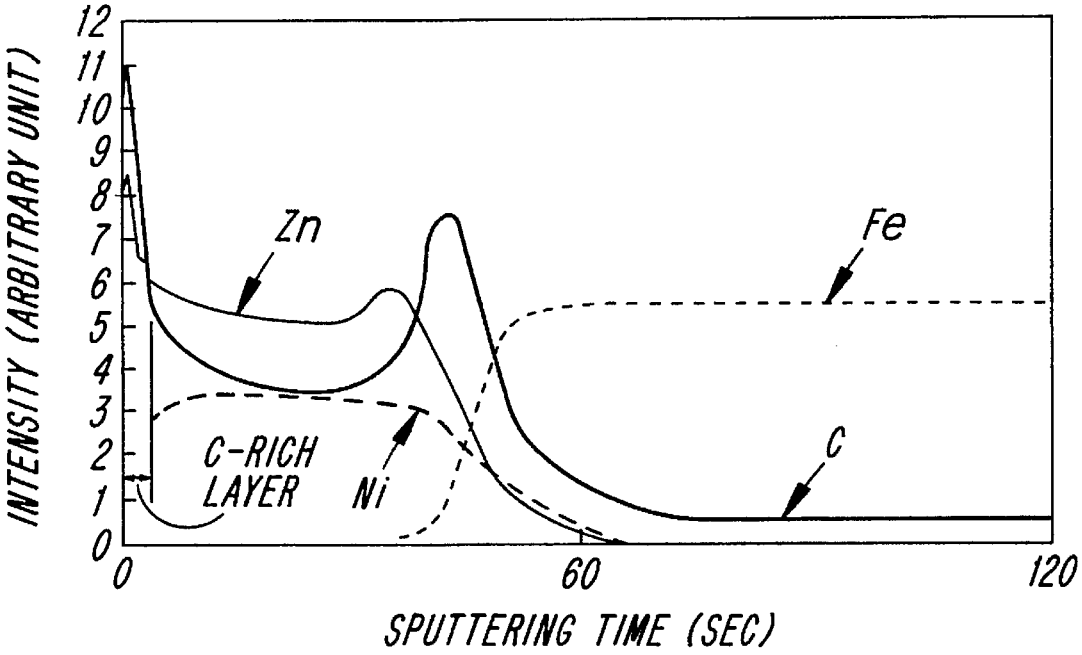
FIG. 1 shows a profile of variation in concentrations of C, Zn, Pc, and Ni across the thickness of a composite Zn-Ni alloy plated steel sheet according to the present invention.

According to this invention, a metal sheet is electroplated with zinc or a zinc alloy in a plating solution containing an organic compound selected from particular species to form a composite plated coating containing co-deposited carbon in an amount of 0.001–10 wt %. The resulting composite zinc-base plated metal sheet has improved press formability, post-painting corrosion resistance, spot weldability, and low-temperature impact resistance while maintaining good corrosion resistance characteristic of a zinc-base coating.

It is known in the art of electroplating to add an organic compound to a plating solution for various purposes. See, e.g., Japanese Patent Applications Laid-Open (Kokai) Nos. 47-34129(1972), 49-91045(1974), 50-155436(1975), 57-19393 (1982) 64-47892(1989), 1-172592(1989), 1-201499(1989), 2-159398 (1990), 2-274891(1990), and 2-285093(1990)- However, the addition of an organic compound disclosed in these documents is mostly for the purpose of improving the brightness of the resulting plated coating. It is surprising that the addition of a particular organic compound to a plating solution results in the formation of a plated coating which contains carbon co-deposited with the plated metal species in such a proportion that co-deposition of carbon brings about significant improvement in spot weldability, post-painting corrosion resistance, and other properties of the plated metal sheet.

Substrate Metal Sheet to be Plated

The metal sheet serving as a substrate to be plated according to this, invention is not critical. The substrate metal sheet is usually a steel sheet, particularly a cold-rolled steel sheet, but it may be selected from other metal sheets depending on the end use and environment of use of the plated metal sheet. For instance, it may be an aluminum sheet for lighter weight.

In order to further improve corrosion resistance, the substrate metal sheet may be a plated metal sheet having a plated coating formed on one or both sides in a conventional manner. In such cases, it is preferred that the plated metal sheet as a substrate be a steel sheet plated with zinc or a zinc alloy (Zn-X, where X is one or more elements selected from Fe, Co, Ni, Mn, Cr, Mg, Sn and Al), or aluminum or an aluminum alloy such as Al-Mn. The plating method is not limited and may be electroplating in a solution or in a molten salt, hot dipping including alloyed galvanizing, or vapor plating. The weight of the plated coating in the substrate plated metal sheet is not critical, but it is preferably in the range of 10–60 g/m$^2$ and more preferably 10–45 g/m$^2$ for each side.

Plating Method

A zinc or zinc alloy coating is formed on one or both surfaces of the substrate metal sheet by electroplating, i.e., cathodic electrodeposition in a plating solution to which an organic compound has been added. The plating bath may be either an acidic bath such as a sulfate or chloride bath, or an alkaline bath such as a cyanide bath. Preferably, an acidic bath, particularly a sulfate bath is used. The plating and pretreatment prior to plating, if necessary, may be performed in a conventional manner except that a certain organic compound is added to the plating solution in the bath.

The organic compound added to the plating solution is selected from alkynes, alkynols, amines and salts thereof, thio compounds, heterocyclic compounds, and aromatic carboxylic acids and salts thereof. One or more of these may be used. The organic compound results in the co-deposition of carbon derived therefrom during cathodic electrodeposition of zinc or a zinc alloy to form a composite electroplated coating containing 0.001–10 wt % carbon (C).

Alkynes are organic compounds having a carbon-carbon triple bond, Examples of useful alkynes include pentyne, hexyne, heptyne, and octyne.

Alkynols are those alkynes in which at least one hydrogen atom is substituted by a hydroxyl group. Examples of useful alkynols include propargyl alcohol, 1-hexyn-3-ol, and 1-heptyn-3-ol.

Amines may be aliphatic, allcyclic, or aromatic amines. Examples of useful amines include alkylamines such as octylamine, nonylamine, decylamine, laurylamine, tridecylamine, and cetylamine; alkenylamines such as propenylamine and butenylamine, alicyclic amines such as cyclohexylamine; and aromatic amines such as aniline.

Thio compounds include alkyl mercaptans such as decyl mercaptan and cetyl mercaptan, dialkyl sulfides such as dimethyl sulfide, thiourea and its derivatives, thioglycolic acid, and the like.

Examples of useful heterocyclic compounds include pyridine, benzothiazole, benzimidazole, benzotriazole, quinoline, indole, thiophene, pyrrole, furan, purine, and the like, as well as their substituted derivatives.

Aromatic carboxylic acids may be either monocarboxylic or polycarboxylic acids and include benzoic acid, cinnamic acid, salicylic acid, toluic acid, naphthalene carboxylic acid, phthalic acid, and terephthalic acid.

Amines including heterocyclic amines and carboxylic acids may be used in the form of salts. Specifically, acid addition salts of amines such as sulfates and hydrochlorides, and metal salts of aromatic carboxylic acids such as alkali metal salts and zinc salts may be used.

The organic compound is added to the plating solution in a concentration of 0.001–10 wt %. Since the concentration of the organic compound in the plating solution has a direct influence on the amount of co-deposited carbon in the resulting plated coating, i.e., the carbon content of the plating, it is adjusted in the above-described range so as to form a composite zinc base plated coating having a desired carbon content in the range of 0.001–10 wt %. The concentration of the organic compound in the plating solution is preferably 0.005–10 wt %. More preferably, it is 0.1–10 wt % for alkynes and alkynols, 3–10 wt % for amines, 0.2–5 wt % for thio compounds 1.5–10 wt % for heterocyclic compounds, and 3–8 wt % for aromatic carboxylic acids.

Typical formulations of a sulfate plating solution and plating conditions for zinc-base electroplating are as follows. However, they are illustrative and not restrictive.

Formulations of plating solution:

$ZnSo_4 \cdot 7H_2O$: 10–400 g/l $Na_2SO_4$ or $(NH_4)_2SO_4$: 10–100 g/l

Organic compound: 0.001–10 wt %

Ph: 1–4

Plating conditions:

Bath temperature: 40°–60° C.

Current density: 10–150 A/dm$^2$

Solution flow rate: 0.05–4 m/sec

In the case of zinc alloy plating, a source of each alloying metal element is further added to the plating solution. The alloying element may be added in the form of a metal salt such as a sulfate, chloride, acetate, carbonate, molybdate, or hypophosphite, as an organometal compound, or as a metal itself. The amount of the alloying element added is generally in the range of 1–40 wt % and is adjusted so as to form a plated coating of a zinc alloy having a desired proportion of the alloying element.

The cathodic electrolysis for electroplating can be performed by passing a direct current as in conventional electroplating.

In a preferred embodiment, the cathodic electrolysis is performed by using either (a) a pulse current having an off-time (separation time) of 1 msec to 1 sec and a duty factor of at least 0.5, or (b) a direct or pulse current on which an alternating current (AC) having a frequency of 1–100 Hz and a current variation peak of ±1%–±50% is superimposed. Electroplating with such a pulse current or a superimposed AC on direct or pulse current in a plating solution containing an organic compound results in the formation of a composite zinc-base plated coating having a significantly increased carbon content compared to that formed by direct current electroplating in the same plating solution having the same content of the organic compound. This is thought to be because the organic compound is relatively readily accessible to the substrate metal sheet and is effectively adsorbed thereby while the pulse current is in the off state or the superimposed AC is in a low-current state, where interference with the polarity of the substrate metal sheet to which a voltage is applied is minimized.

Furthermore, a composite zinc-base plated coating formed by electroplating with the above-described pulse current or superimposed AC on direct or pulse current is advantageous in that it has a decreased level of internal stress and a reduced number of cracks and pinholes. Therefore, the resulting plated coating has improved adhesion to the substrate sheet, adhesion to painting, and bare corrosion resistance, in addition to improved spot weldability and press formability which is mainly attributable to the increased carbon content. Thus, it is superior in performance to a similar composite plated coating formed by conventional electroplating with a direct current. In other words, the above-described electroplating technique makes it possible to achieve the same level of improvement with a thinner plated coating than is possible using a conventional technique. Therefore, such an electroplating technique is particularly effective in the formation of a relatively thin plated coating.

Plated coating

As described above, cathodic electrolysis in a plating solution containing an organic compound selected from particular species results in the formation of a composite zinc-base plated coating containing co-deposited carbon in such an amount that the coating has a carbon content of 0.001–10 wt %. The plated coating preferably has a carbon content of 0.05–5 wt % and more preferably 0.5–3 wt %.

The carbon content of a plated coating on substrate metal sheet can be determined by combustion and analysis of the generated gas after the plated coating has been mechanically removed from the substrate metal sheet.

It has been found that a composite zinc-base plated coating containing co-deposited carbon has improved spot weldability. This is because, compared to a carbon-free conventional zinc-base plated coating, it has an increased electric resistivity and generates a remarkably increased amount of heat in resistance spot welding, thereby facilitating the formation of a weld zone referred to as a nugget. Co-deposition of carbon also serves to harden the plated coating and decrease its coefficient of friction, thereby rendering the coating less susceptible to seizure with a die during press forming and contributing to improvement in press formability.

The co-deposited carbon does not adversely affect the bare (as-plated) corrosion resistance of the coating to a substantial degree as long as its carbon content is not greater than 10 wt %. In the case of plating with a zinc alloy, the post-painting corrosion resistance of the resulting plated coating is often improved by co-deposition of carbon. In the case of plating with zinc metal, good post-painting corrosion resistance inherent to zinc coatings is maintained in the resulting composite zinc coating containing co-deposited carbon.

When the carbon content of the composite plated coating is less than 0.001 wt %, co-deposition of carbon does not give rise to a significant improvement in properties of the coating. The presence of more than 10 wt % carbon causes the plated coating to have a decreased ductility, thereby rendering it more susceptible to powdering in press forming, and also deteriorates the surface appearance of the plated coating.

The composite zinc-base plated coating has a coating weight of 0.5–200 g/m$^2$. A coating weight of less than 0.5 g/m$^2$ will not provide a sufficient rust-preventing effect by the zinc-base coating, while an extremely thick coating with a weight of more than 200 g/m$^2$ is costly and adversely affects the press formability and spot weldability of the plated metal sheet. The coating weight can be selected depending on the desired level of corrosion resistance, the degree of corrosiveness of the substrate metal sheet, and the basic anticorrosive properties of the zinc or zinc alloy to be plated.

For example, when the substrate metal sheet is a steel sheet, the coating weight of the composite zinc base plated coating is preferably in the range of 5–200 g/m$^2$. In such cases, a coating weight of less than 5 g/m$^2$ is not enough to provide the plated steel sheet with adequate rust-preventing properties. The coating weight is more preferably in the range of 10–120 g/m$^2$ and most preferably in the range of 20–60 g/m$^2$.

When the substrate metal sheet is a plated steel sheet, particularly one having a plated coating of Zn or Al or an alloy of Zn or Al, the plated coating of the substrate sheet, which lies beneath the composite zinc-base plated coating according to this invention, provides corrosion resistance to a certain degree. In such cases, the composite zinc-base plated to coating may be thin enough to provide the plated steel sheet with improved spot weldability and press formability. Therefore, it is preferable that the composite zinc-base plated coating formed on a plated steel sheet as a substrate sheet be a thin coating having a weight in the range of 0.5–20 g/m$^2$ as formed by so-called flash plating. The coating weight is more preferably in the range of 1–10 g/m$^2$ and most preferably in the range of 2–5 g/m$^2$.

The type of plating may be either zinc plating or zinc alloy plating. Preferably it is zinc alloy plating, since improvement in properties attained by co-deposition of carbon in the plated coating in accordance with this invention is generally greater in zinc alloy plating than in zinc plating. The alloying metal element in the case of zinc alloy plating may be one or more metals selected from Fe, Ni, Co, Mn, Cr, and Sn. Preferable alloying elements are Fe, Co, and Ni.

In the case of a carbon-containing composite zinc alloy plated coating, the total content of the alloying metal elements in the zinc alloy coating is 0.2–30 wt %, preferably 0.2–20 wt %, and more preferably 0.4–10 wt %, based on the total content of metallic elements in the coating. A content of an alloying metal element referred to hereinafter is based on the total metal elements.

Most preferably, the zinc alloy coating contains cobalt (Co) in an amount of 0.4–2 wt %. The presence of a small proportion of cobalt in a carbon-containing composite zinc-base plated coating has a marked effect on improvement in corrosion resistance and spot weldability of the composite coating. The Co content is preferably in the range of 0.5–1.5 wt %.

A composite zinc alloy plated coating containing co-deposited carbon formed by zinc alloy plating in accordance with this invention has the feature in chemical structure that it has a carbon-rich surface layer. Thus, the carbon concentration is not even across the thickness of the coating, but increases toward the surface whereby the carbon concentration in the surface area of the coating is much higher than that in the area adjacent to the substrate sheet. The formation of such a carbon-rich layer is also observed in the case of zinc metal plating according to the present invention, but much less significantly. It has been found that a composite zinc alloy plated coating containing 0.001–10 wt % of co-deposited carbon exhibits particularly improved properties when the carbon-rich surface layer formed therein has a thickness which is in the range of 0.1–10 μm and which constitutes 5% to 50% of the thickness of the plated coating.

Accordingly, in a preferred embodiment, the composite zinc-base plated coating is a composite zinc alloy coating containing 0.001–10 wt % of carbon and at least 0.2 wt % in total of one or more alloying metal elements, and the composite zinc alloy plated coating has a carbon-rich surface layer with a thickness of 0.1–10 μm, which thickness constitutes from 5% to 50% of the thickness of the plated coating.

It is estimated that the presence of an alloying metal element, which is generally nobler and more susceptible to cathodic electrolysis than zinc, in a plating solution serves to retard electrolytic reactions of an organic compound added to the solution, whereby carbon is deposited mainly in the late stage of electrolytic deposition and enriched in a surface layer of the resulting plated coating. Thus, although formed by a single plating step, the composite zinc alloy plated coating has two layers, a carbon-rich surface layer and a carbon-poor lower layer, and it can function like a duplex (two layer) plated coating.

The term "carbon-rich layer" used herein means an area of a plated coating where the carbon concentration is higher than the mean carbon concentration in the profile of carbon concentration taken across the thickness of the coating. The profile of carbon concentration across the thickness (in the depth direction) of a plated coating can be determined by glow discharge mass spectrometry, and the mean carbon concentration across the thickness can be then determined from the profile. The profile has an area adjacent to the outer surface in which the carbon concentrations are higher than the mean carbon concentration. This area corresponds to a carbon-rich surface layer, the thickness of which can be determined from the profile.

The carbon-rich surface layer has a carbon concentration up to 2 to 3 times the mean carbon concentration of the plated coating. Therefore, it has an increased resistivity and hardness and is highly effective for improvement of spot weldability and press formability. Since carbon is enriched only in the surface layer and the underlying layer has a lower carbon concentration, the good corrosion resistance characteristic of a zinc alloy coating is not deteriorated significantly.

When the thickness of the carbon-rich surface layer is less than 0.5 μm or constitutes less than 5% of the thickness of the plated coating, spot weldability is not improved sufficiently. When it is greater than 10 μm or constitutes greater than 50% of the thickness of the plated coating, the electrodes tend to be severely contaminated with carbon deposited at the center of the electrodes during continuous spot welding. As a result, an insulating area is formed on the electrodes, and this interferes with the formation of a nugget, thereby deteriorating spot weldability.

Preferably the thickness of the carbon-rich surface layer is 0.1–5 μm and constitutes 5–40% of the plated coating and more preferably it is 0.5–3 μm and constitutes 10–30% of the thickness of the plated coating.

Furthermore, a composite zinc alloy plated coating containing co-deposited carbon formed by zinc alloy plating in accordance with this invention is improved in post-painting corrosion resistance and low-temperature impact resistance in addition to spot weldability and press formability when the content of alloying elements is not greater than 10 wt % in total.

Such a composite zinc alloy coating containing not greater than 10 wt % of alloying elements in total has a zinc metal phase called an η-phase in the alloy microstructure. The presence of an η-phase can conveniently be determined by X-ray diffractometry since an X-ray diffraction pattern has characteristic peaks if an η-phase is present in the coating.

The post-painting corrosion resistance in areas where the painted coating is injured and in edge faces is basically assured by the sacrificial anticorrosive effect of the zinc base coating. Therefore, the presence of an η-phase, which has a high sacrificial anticorrosion effect, tends to improve the post-painting corrosion resistance of the coating. The η-phase is also effective for improvement in low-temperature impact resistance due to its ductility, which is higher than that of intermetallic compounds found in a Zn alloy and which serves to prevent propagation of cracks formed in the coating by impact.

The crystal structure of an η-phase is a close-packed hexagonal structure aligned in the direction of the c-axis, and it therefore has crystallographic orientation. As a result of a crystallographic investigation by X-ray diffractometry to determine the orientation of the η-phase present in carbon-containing composite zinc alloy plated coatings, it has been found that those coatings exhibiting improved post-painting corrosion resistance have the crystallographic feature that they have an orientation index of not greater than 0.8 for the (00·2) plane of the η-phase and not less than 0.2 for the (10·1) plane thereof. It is thought that the alloying metal element deposited preferentially on the substrate sheet in an early stage of electrolytic deposition causes the orientation of the η-phase deposited thereafter to change The orientation index of a given plane of an η-phase is an indication of the orientation in the plane of a test sample relative to that of a standard zinc metal sample specified in ASTM. It is calculated from the intensities of diffraction of the planes of the η-phase by the following equation for the (00·2) plane, for example:

$$\text{Orientation Index } (00{\cdot}2) = \frac{IF_{00\cdot2}}{IR_{00\cdot2}}$$

$$IF_{00\cdot2} = \frac{I_{00\cdot2}}{I_{00\cdot2} + I_{10\cdot0} + I_{10\cdot1} + I_{10\cdot2} + I_{10\cdot3} + I_{11\cdot0}}$$

$$IR_{00\cdot2} = \frac{IR_{00\cdot2}}{IR_{00\cdot2} + IR_{10\cdot0} + IR_{10\cdot1} + IR_{10\cdot2} + IR_{10\cdot3} + IR_{11\cdot0}}$$

where $I_{xx\cdot x}$ is the peak intensity of the (xx·x) plane in an x-ray diffraction pattern of a test sample; and $IR_{xx\cdot x}$ is the peak intensity of the (xx·x) plane in an X-ray diffraction pattern of a standard sample.

The angles of diffraction (Co 2θ) of the planes of the η-phase are 42.4° for the (00·2) plane, 45.6° for the (10·0) plane, 50.7° for the (10·1) plane, 64.0° for the (10·2) plane, 83.6° for the (10·3) plane, and 84.4° for the (11·0) plane.

It is thought that a composite zinc alloy plated coating having an η-phase which meets the above-described requirements for orientation of the (00·2) and (10·1) planes has an increased reactivity with a treating solution in a chemical conversion treatment such as phosphating, which is performed on the coating prior to painting, thereby causing the resulting chemical conversion film to adhere to the underlying coating firmly and improving the post-painting corrosion resistance. Preferably, the orientation index is not greater than 0.7 for the (00·2) plane and not less than 0.25 for the (10·1) plane.

Thus, in a composite zinc alloy plated coating formed in accordance with this invention which contains up to 10 wt % of alloying elements, a particularly improved post-painting corrosion resistance can be achieved by the sacrificial anticorrosive effect of an η-phase and the improved adhesion of a chemical conversion film resulting from the above-described orientation of the η-phase. The presence of a ductile η-phase also contributes to improved low-temperature impact resistance.

The composite zinc alloy plated coating containing up to 10 wt % of alloying elements possesses both the above-described features in chemical structure and orientation of the η-phase. However, it is not necessary to examine whether a given composite zinc alloy coating has both features. Accordingly, in order to obtain the above-described improved properties, it is sufficient to examine either the chemical structure of a composite zinc alloy plating to confirm that it has the above-described carbon-rich surface layer or the crystallographic orientation of the η-phase to confirm that it has the above-described orientation indices. For example, when the substrate metal sheet is a zinc- or zinc alloy-plated steel sheet having η-phase, the X-ray diffraction pattern of a composite zinc alloy plated coating formed on the substrate sheet includes those diffractions from the η-phase present in the substrate sheet, too. Therefore, it is impossible to examine the orientation of the η-phase present in the composite plated coating on the substrate sheet from the X-ray diffraction pattern. In such cases, only the chemical structure of the plated coating can be examined.

A composite zinc-base plated metal sheet according to this invention has improved press formability, spot weldability, applicability to chemical conversion treatment and subsequent painting, post-painting corrosion resistance, and low-temperature impact resistance while maintaining good as-plated (bare) corrosion resistance. Therefore, it is suitable for use in various applications including automobile panels, building materials, and electric appliances.

The corrosion resistance can be improved by further coating the plated metal sheet with a chromate film, which has improved anticorrosive effect, and a thin organic resin coating, which acts as a barrier shielding from a corrosive environment. Therefore, such further coating may be applied, if desired. The resulting coated product is a composite organic-inorganic coated metal sheet having a three-layer coating consisting of an undermost carbon-containing zinc-base plated coating, an intermediate chromate film, and an upper organic resin coating on at least one surface of a substrate metal sheet.

Chromate film

The chromate film, if applied, may be formed by a conventional chromating process of the coating type, reaction type, or electrolysis type, although the coating type is preferred since it can form a chromate film having improved corrosion resistance. The chromating process of the coating type comprises application of a chromating solution containing chromic acid or its salt and a reducing agent followed by heating to give a dry film formed by reduction of $Cr^{4+}$ ions to $Cr^{3+}$ ions. In order to accelerate the film formation by reduction at a relatively low temperature, the chromating process of the coating type can be performed by the two-stage reduction technique in which a partially-reduced chromating solution is used.

The coating weight of the chromate film is 10–200 mg/m$^2$ and preferably 30–120 mg/m$^2$ as Cr metal. A coating weight of less than 10 mg/m$^2$ cannot produce an appreciable improvement in corrosion resistance, while a weight of more than 200 mg/m$^2$ may adversely affect the electrodeposition coatability and spot weldability.

In addition to chromic acid or its salt and a reducing agent, the chromating solution used to form a chromate film may further contain one or more additives selected from known classes such as colloidal silica, acids, and water-soluble or water-dispersible resins.

Organic resin coating

The chromate film is overlaid with an organic resin coating having a thickness of 0.1–2 μm. A thickness of less than 0.1 μm is not enough to provide an improvement in corrosion resistance, while an organic resin film thicker than 2 μm adversely affects the spot weldability and electrodeposition coatability. The thickness of the organic resin coating is preferably 0.6–1.4 μm.

The organic resin coating may be formed from any organic resin-based coating composition conventionally employed in the production of precoated steel sheets. Preferably, the base resin is of the thermosetting type in view of the simplicity of the equipment required and a relatively rapid film-forming speed, but the base resin may be of the radiation- or electron beam-curable type or room temperature curing type.

An organic resin coating of the thermosetting type is prepared by application of a resin-based coating composition, followed by baking to cure the resin. The coating composition may further contain, in addition to the base resin, a curing agent or catalyst, a solvent, and one or more additives such as inorganic fillers, pigments including color pigments, rust-preventive pigments, and extender pigments, plasticizers, and lubricants.

The class of base thermosetting resin employed is not critical and various resins including acrylic resins, urethane resins, and polyester resins may be used. Particularly preferred as a base resin is an epoxy resin.

The epoxy resin may be a polyglycidyl ether type such as bisphenol-A, bisphenol-F, novolac, or brominated epoxy resin. Alternatively, it may be a modified epoxy resin including an epoxyester resin, which is an epoxy resin modified with drying oil-derived fatty acids and an isocyanate so as to react the epoxy and hydroxyl groups in the epoxy resin with carboxyl groups in the fatty acids, and a urethane-modified epoxy resin, which is an epoxy resin modified by reaction with an isocyanate.

Another preferable resin which can be used in the present invention as a kind of epoxy resin is a polyhydroxypolyether resin, which is a polymer prepared by polycondensation of a dihyric phenol with a nearly equimolar amount of an epihalohydrin in the presence of an alkali catalyst.

An epoxy resin-based coating composition may further contain one or more additional resins other than epoxy resins in order to improve various properties of the resulting resin coating, such as formability, flexibility, lubricity, and electrodeposition coatability. For example, a butyral resin may be added to improve the flexibility or a water-soluble resin may be added to improve the electrodeposition coatability of the resin coating. Such an additional resin, if added, is preferably present in a proportion of not greater than 50 wt % of the total resin solids so as not to significantly deteriorate the corrosion resistance.

Preferably, a cross-linking agent (curing agent) is added to the epoxy resin-based coating composition in order to further improve the corrosion resistance of the resin coating. Examples of useful cross-linking agents are phenolic resins, amino resins, polyamides, amines, blocked isocyanates, and acid anhydrides, and one or more of these can be used. The amount of a cross-linking agent added is preferably such that the number of cross-linkable functional groups in the agent is from 0.1 to 2.0 times the total number of epoxy and hydroxyl groups in the resin.

The addition of an inorganic filler to a coating composition is also effective to further improve the corrosion resistance of the resin coating. Useful inorganic fillers include colloidal or fumed silica, various silicate minerals, alumina, calcium carbonate, zinc phosphate, calcium phosphate, zinc phosphomolybdate, aluminum zinc phosphomolybdate, and the like. The amount of an inorganic filler added is preferably 1–30 wt % based on the total resin solids.

Preferable pigments include metal chromate-type rust-preventive pigments such as strontium chromate and zinc chromate. When the composite organic-inorganic coating is applied to only one surface of the substrate metal sheet, a color pigment may be added to the resin-based coating composition such that the coated surface can be easily distinguished.

The following examples are presented to further illustrate the present invention. These examples are to be considered in all respects as illustrative and not restrictive. In the examples, all percents and parts are by weight unless otherwise indicated, and coating weights are for each side of a sheet.

The basic compositions of plating solutions and electroplating conditions employed In the examples are as follows.

TABLE 1

| Composition of Plating-Solution | | Electroplating Conditions | |
|---|---|---|---|
| $ZnSO_4.7H_2O$: | 80–160 g/l | Bath temp.: | 50 ± 10° C. |
| $Na_2SO_4$: | 10–65 g/l | Current density: | 10–120 A/dm$^2$ |
| pH: | 1.6–2.6 | Flow rate: | 0.06–1.40 m/s |
| Sources of alloying elements used in zinc alloy plating | | | |
| $FeSO_4.7H_2O$: | 125–280 g/l, | $NiSO_4.6H_2O$: | 125–280 g/l, |
| $CoSO_4.7H_2O$: | 10–280 g/l, | $MnSO_4.4H_2O$: | 10–280 g/l, |
| $Cr_2(SO_4)_2.xH_2O$: | 10–280 g/l, | $SnCl_2$: | 10–160 g/l |

EXAMPLE 1

A 0.8 mm thick cold-rolled steel sheet as a substrate sheet was subjected to electroplating with zinc or a zinc alloy by cathodic electrolysis with a direct current in a plating solution to which an organic compound had been added to form a carbon-containing composite zinc-base plated coating on each surface of the steel sheet. For comparison, no organic compound was added to the plating solution in some runs.

The organic compound used and the amount thereof added to the plating solution, the weight of the plated coating, and the carbon content thereof (determined by combustion of a mechanically removed sample of the plated coating and gas analysis of the generated gas) in each run are shown in Table 2.

The resulting composite zinc-base plated steel sheets were evaluated with respect to post-painting corrosion resistance in an injured area and edge faces, press formability, and spot weldability according to the following test methods. The test results are also shown in Table 2.

Post-Painting Corrosion Resistance

Corrosion resistance in injured areas

A test specimen measuring 70 mm×150 mm was cut from each plated steel sheet and painted by a process comprising treatment with a degreasing agent FC 4336, then with a conditioner PZT, and finally with a phosphating solution PB-L3080 (all manufactured by Nippon Parkerizing), then coating with a cationic electrodeposition coating to a thickness of 20±1 μm using a coating composition U-80 (Nippon Paint) followed by baking for 25 minutes at 175° C., intercoating with an alkyd-based coating composition for automobiles to a thickness of 40 μm followed by baking, and top coating with a melamine-polyester coating composition to a thickness of 40 μm followed by baking.

The resulting painted test specimen was injured by scribing crossed lines with a knife to a depth sufficient to reach the substrate steel sheet and was subjected to an accelerated cyclic corrosion test with a 24 hour-cycle consisting of salt spraying for 7 hours at 35° C. using a 5% NaCl solution, drying for 2 hours at 50° C., and humidifying for 15 hours at 50° C. and a relative humidity of 95%.

After 30 cycles, the width of blisters (W) observed along the scribed lines was measured, and post-painting corrosion resistance in the injured area was evaluated as follows.

⊙: W<0.5 mm

O: 0.5 mm ≦W<1.0 mm

Δ: 1.0 mm≦W<2.0 mm

X: 2.0 mm≦W<3.0 mm

XX: W≧3.0 mm

Corrosion resistance in edge

A test specimen was blanked out by a press in which the die clearance was adjusted such that a burr was formed to a height corresponding to 10% of the sheet thickness. The blanked test specimen was then painted by the above-described process, and the painted test specimen was subjected to the above-described accelerated cyclic corrosion test.

After 60 cycles, the percent of the area of the edge face covered with red rust (S) was measured, and post-painting corrosion resistance in edge was evaluated as follows.

⊙: No red rust

O: S≦5%

Δ: 5%<S≦10%

X: 10%<S≦30%

XX: S>30%

Press Formability

Workability

A round blank having a diameter of 90 mm was cut and subjected to deep drawing into a cylindrical cup measuring 50 mm in diameter and 28 mm in depth. The plated coating on the outer side wall of the press-formed cup was subjected to a Scotch tape test to measure the degree of plated coating peeled off by adhesion to the tape. The results were evaluated in terms of the percent of the area of the tape on which peeled coating was adhered (T) as follows.

5: No adhesion of peeled coating

4: T<10%

3: 10%≦T<30%

2: 30%≦T<50%

1: All-over adhesion of peeled coating

Formability

The formability was evaluated in the following manner by visually observing the blank during the above-described deep drawing with respect to fracture of the blank.

⊙: No fracture at the end of deep drawing

O: No fracture up to a depth of 20 mm

X: Fractured before a depth of 20 mm

Spot Weldability

Two test specimens of the plated steel sheet obtained in each run were welded by continuous spot welding using a single-phase AC spot welder under the following conditions:

Current passed: 10,000 A

Welding force: 200 kgf

Weld time: 10 cycles (at 60 Hz)

Shape of electrodes: Dome shape

Continuous spot welding was performed with a welding cycle consisting of welding of consecutive 20 spots at intervals of 2 seconds followed by a rest of 40 seconds. Three welded spots were taken at random from each 100 spots to determine the nugget diameters after the welded spots were pulled apart. The spot weldability was evaluated by the number of welded spots (N) before the nugget diameter decreased to 3.6 mm or smaller as follows.

⊙: N ≧2000

O: 2000>N≧1500

Δ: 1500>N≧1000

X: N<1000

As can be seen from Table 2, all the composite zinc-base plated steel sheet according to this invention had good post-painting corrosion resistance, press formability, and spot weldability.

EXAMPLE 2

A steel sheet was subjected to electroplating with zinc or a zinc alloy using a plating solution to which an organic compound had been added, following the procedure described in Example 1 except that the current passed was a pulse current or an alternating current superimposed on a direct or pulse current as shown in Table 3. In Table 3, Currents A to C were pulse currents, Currents D and E were superimposed AC's on DC's, and Current F was a superimposed AC on pulse current. For example, Current D was a direct current having a current density of 60 A/dm$^2$ on which an alternating current having a current variation peak of ±0.6 A (corresponding to ±1.0% of 60 A) was superimposed. Similarly, Current E was a direct current having a current density of 90 A/dm$^2$ on which an alternating current having a current variation peak of ±45 A (corresponding to ±50% of 90 A) was superimposed.

TABLE 2

| | Composition of Plated Coating | | | | | Post-Painting Corrosion Resistance | | Press Formability | | |
|---|---|---|---|---|---|---|---|---|---|---|
| Run No. | Plated Metal | Coating Weight (g/m$^2$) | Organic Compound Added to Plating Bath Species | wt % | wt % C | Injured Area | Injured Edge | Workability | Formability | Weldability |
| THIS INVENTION | | | | | | | | | | |
| 1 | Zn—13% Ni | 5 | 1-hexyne | 2 | 0.8 | O | O | 5 | ⊙ | ⊙ |
| 2 | | 5 | 1-hexyn-3-ol | 1 | 0.2 | O | O | 5 | ⊙ | ⊙ |
| 3 | | 20 | laurylamine | 3 | 1.2 | ⊙ | ⊙ | 5 | ⊙ | ⊙ |
| 4 | | 20 | phenylthiourea | 0.7 | 0.5 | ⊙ | ⊙ | 5 | ⊙ | ⊙ |
| 5 | | 20 | benzimidazole | 0.5 | 1.0 | ⊙ | ⊙ | 5 | ⊙ | ⊙ |
| 6 | Zn | 40 | zinc benzoate | 7 | 1.0 | ⊙ | ⊙ | 5 | ⊙ | ⊙ |
| 7 | | 60 | benzotriazole | 0.5 | 0.7 | ⊙ | ⊙ | 5 | ⊙ | ⊙ |
| 8 | | 80 | 1-hexyne | 0.1 | 0.02 | ⊙ | ⊙ | 5 | O | O |
| 9 | | 80 | 1-hexyn-3-ol | 0.1 | 0.02 | ⊙ | ⊙ | 5 | O | O |
| 10 | | 80 | laurylamine | 3 | 1.2 | ⊙ | ⊙ | 5 | ⊙ | ⊙ |
| 11 | Zn—1% Co | 20 | phenylthiourea | 1 | 1.4 | ⊙ | ⊙ | 5 | ⊙ | ⊙ |
| 12 | | 20 | benzimidazole | 5 | 4.7 | ⊙ | ⊙ | 5 | ⊙ | ⊙ |
| 13 | | 20 | zinc benzoate | 3 | 2.0 | ⊙ | ⊙ | 5 | ⊙ | ⊙ |
| 14 | | 30 | 1-hexyn-3-ol | 5 | 1.1 | ⊙ | ⊙ | 5 | ⊙ | ⊙ |
| 15 | Zn—10% Cr | 30 | phenylthiourea | 2 | 0.9 | ⊙ | ⊙ | 5 | ⊙ | ⊙ |
| 16 | Zn—23% Mn | 30 | benzimidazole | 0.5 | 0.3 | ⊙ | ⊙ | 5 | ⊙ | ⊙ |
| 17 | | 20 | dimethyl sulfide | 1 | 0.7 | ⊙ | ⊙ | 5 | ⊙ | ⊙ |
| 18 | Zn—15% Fe | 20 | benzimidazole | 4 | 2.3 | ⊙ | ⊙ | 5 | ⊙ | ⊙ |
| 19 | | 20 | zinc benzoate | 5 | 2.4 | ⊙ | ⊙ | 5 | ⊙ | ⊙ |
| 20 | | 20 | phenylthiourea | 10 | 7.0 | ⊙ | ⊙ | 5 | ⊙ | ⊙ |
| 21 | | 20 | 1-hexyne | 0.05 | 0.002 | O | O | 5 | ⊙ | ⊙ |
| COMP | | | | | | | | | | |
| 22 | Zn—13% Ni | 30 | —* | — | —* | ×× | × | 2 | ⊙ | Δ |
| 23 | Zn | 60 | —* | — | —* | ⊙ | ⊙ | 5 | × | × |
| 24 | Zn—10% Fe | 45 | —* | — | —* | × | × | 2 | ⊙ | Δ |
| 25 | Zn—10% Cr | 30 | —* | — | —* | Δ | O | 2 | ⊙ | × |
| 26 | Zn—1% Co | 30 | —* | — | —* | ⊙ | O | 5 | × | × |
| 27 | Zn—28% Mn | 20 | —* | — | —* | × | ×× | 1 | O | Δ |

*Outside the range defined herein

TABLE 3

| Type | Current Density ($A/dm^2$) | Shape of Pulse Current: Off time (msec) | Shape of Pulse Current: Duty factor | Wave Form of Superimposed Alternating Current: Frequency (Hz) | Wave Form of Superimposed Alternating Current: Current variation peak |
|---|---|---|---|---|---|
| A | 80 | 1000 | 0.5 | — | — |
| B | 80 | 1 | 0.99 | — | — |
| C | 60 | 500 | 0.8 | — | — |
| D | 60 | — | — | 100 | ±1.0% |
| E | 90 | — | — | 1 | ±50% |
| F | 90 | 400 | 0.9 | 50 | +25% |

The resulting composite zinc-base plated steel sheets were evaluated with respect to post-painting corrosion resistance in injured area and edge faces, press formability, and spot weldability in the same manner as described in Example 1. The test results are shown in Table 4 along with the organic compound used and the amount thereof added to the plating solution, the type of current passed, and the weight and carbon content of the plated coating.

By comparison of the results shown in Tables 2 and 4, it can be seen that the passage of a pulse current or a superimposed AC on direct or pulse current makes it possible to form a composite zinc-base plated coating having an increased carbon content with the same or a smaller amount of an organic compound added.

TABLE 4

| Run No. | Composition of Plated Coating: Plated Metal | Coating Weight ($g/m^2$) | Organic Compound Added to Plating Bath: Species | wt % | wt % C | Current Type Passed | Post-Painting Corrosion Resistance: Injured Area | Post-Painting Corrosion Resistance: Edge | Press Formability: Workability | Press Formability: Formability | Spot Weldability |
|---|---|---|---|---|---|---|---|---|---|---|---|
| THIS INVENTION | | | | | | | | | | | |
| 1 | Zn—13% Ni | 5 | 1-hexyne | 0.9 | 1.9 | A | ◎ | ◎ | 5 | ◎ | ◎ |
| 2 | | 5 | 1-hexyn-3-ol | 0.001 | 0.003 | A | ○ | ○ | 5 | ◎ | ◎ |
| 3 | | 20 | laurylamine | 0.3 | 0.7 | B | ◎ | ◎ | 5 | ◎ | ◎ |
| 4 | | 20 | phenylthiourea | 0.77 | 2.9 | E | ◎ | ◎ | 5 | ◎ | ◎ |
| 5 | | 20 | benzimidazole | 0.25 | 3.8 | F | ◎ | ◎ | 5 | ◎ | ◎ |
| 6 | Zn—4% Ni | 40 | zinc benzoate | 1.5 | 2.7 | C | ◎ | ◎ | 5 | ◎ | ◎ |
| 7 | | 60 | benzotriazole | 0.05 | 0.4 | D | ◎ | ◎ | 5 | ◎ | ◎ |
| 8 | | 80 | 1-hexyne | 0.02 | 0.7 | F | ◎ | ◎ | 5 | ○ | ◎ |
| 9 | | 80 | 1-hexyn-3-ol | 0.1 | 0.6 | E | ◎ | ◎ | 5 | ◎ | ◎ |
| 10 | | 80 | laurylamine | 1.2 | 3.5 | B | ◎ | ◎ | 5 | ◎ | ◎ |
| 11 | Zn—1% Co | 20 | phenylthiourea | 0.3 | 2.6 | D | ◎ | ◎ | 5 | ◎ | ◎ |
| 12 | | 20 | benzimidazole | 0.7 | 3.3 | F | ◎ | ◎ | 5 | ◎ | ◎ |
| 13 | | 20 | zinc benzoate | 0.1 | 0.4 | C | ◎ | ◎ | 5 | ◎ | ◎ |
| 14 | | 30 | 1-hexyn-3-ol | 0.5 | 1.6 | C | ◎ | ◎ | 5 | ◎ | ◎ |
| 15 | Zn—10% Cr | 30 | phenylthiourea | 1.2 | 3.8 | F | ◎ | ◎ | 5 | ◎ | ◎ |
| 16 | Zn—23% Mn | 30 | benzimidazole | 0.2 | 1.1 | A | ◎ | ◎ | 5 | ◎ | ◎ |
| 17 | | 20 | dimethyl sulfide | 0.05 | 0.2 | A | ◎ | ○ | 5 | ◎ | ◎ |
| 18 | Zn—15% Fe | 20 | benzimidazole | 0.2 | 1.5 | B | ◎ | ◎ | 5 | ◎ | ◎ |
| 19 | | 20 | phenylthiourea | 1.2 | 5.8 | E | ◎ | ◎ | 5 | ◎ | ◎ |
| 20 | | 20 | 1-hexyne | 0.001 | 0.006 | E | ◎ | ○ | 5 | ◎ | ◎ |
| 21 | | 20 | 1-hexyne | 0.05 | 0.11 | E | ◎ | ◎ | 5 | ◎ | ◎ |
| 22 | Zn | 60 | phenylthiourea | 0.3 | 1.7 | C | ◎ | ◎ | 5 | ◎ | ◎ |
| 23 | | 60 | benzimidazole | 0.5 | 2.2 | C | ◎ | ◎ | 5 | ◎ | ◎ |
| COMP | | | | | | | | | | | |
| 24 | Zn—13% Ni | 30 | —* | — | —* | C | ×× | × | 3 | ◎ | × |
| 25 | Zn | 60 | —* | — | —* | A | ◎ | ◎ | 5 | × | × |
| 26 | Zn—4% Ni | 60 | —* | — | —* | E | ◎ | ◎ | 5 | × | × |
| 27 | Zn—15% Fe | 20 | —* | — | —* | D | × | × | 3 | ◎ | Δ |
| 28 | Zn—1% Co | 20 | —* | — | —* | D | ◎ | ○ | 5 | × | × |

*Outside the range defined herein

EXAMPLE 3

This example illustrates electroplating with a composite zinc-base coating on a zinc-base or aluminum-base plated steel sheet as a substrate sheet.

In Table 5, the lower plated coating indicates the plated coating of the substrate plated steel sheet, while the upper plated coating indicates the composite zinc-base plated coating according to this invention. All the electroplating with zinc or a zinc alloy for lower and upper coating was performed using a sulfate bath having the above-described basic composition under the above-described conditions.

When the substrate sheet was a zinc-base electroplated steel sheet, a 0.8 mm thick cold-rolled steel sheet was initially electroplated with zinc or a zinc alloy in an organic compound-free plating solution to form a lower plated coating on each surface. The resulting plated steel sheet, which was used as a substrate sheet, was then rinsed with water and immediately passed to a plating solution containing an organic compound to form a composite zinc-base electroplated coating as an upper coating on each surface.

When the lower plated coating was an aluminum-base coating or a galvanized (hot-dipped zinc) coating, a commercially available plated steel sheet having such a coating was used as a substrate plated steel sheet, and it was immersed for 15 seconds in an aqueous solution containing 60 g/l of NaOH at 70° C. for surface activation and then rinsed with water before it was subjected to electroplating to form the upper plated coating.

After the resulting duplex plated steel sheet was rinsed with water and dried, a part of the plated steel sheet was further coated with a chromate film with a coating weight of 60 mg/m$^2$ as Cr on one surface thereof using a commercially available partially-reduced chromating solution of the coating type. The chromate film was formed by heating for 30 seconds at 140° C. Thereafter, the chromate film was overlaid with a 1.0 μm-thick resin coating formed by application of an epoxy-based coating composition with a bar coater followed by baking for 30 seconds at 140° C. to give a composite organic-inorganic coated steel sheet. The epoxy-based coating composition was prepared by mixing 65 parts of an epoxy resin of the bisphenol-A type, 15 parts of a phenolic resin as a cross-linking agent, 15 parts of fumed silica, and 5 parts of a polyethylene wax as a lubricant in cyclohexanone in an amount sufficient to adjust the non-volatile content to 20%.

The types and coating weights of the lower and upper plated coatings, the organic compound and the amount thereof added to the plating solution fez upper coating, and the carbon content of the upper coating are shown in Table 5.

The as-plated duplex plated steel sheet and the composite organic-inorganic coated steel sheet were evaluated with respect to post-painting corrosion resistance, press formability, and spot weldability in the same manner as described in Example 1. The test results, which are also shown in Table 5, were the same for the as-plated steel sheet and for the composite organic-inorganic coated steel sheet having a chromate film and an organic resin film. Although not shown in the table, the composite organic-inorganic coated steel sheet had much improved bare corrosion resistance over the as-plated steel sheet.

All the duplex plated steel sheets in which the upper plated coating contained co-deposited carbon had improved post-painting corrosion resistance, press formability, and spot weldability compared to comparative duplex plated steel sheets having a carbon-free upper plated coating.

TABLE 5

| | Composition of Plated Coating | | | | | | | |
|---|---|---|---|---|---|---|---|---|
| | Lower Plated Coating | | | Upper Plated Coating | | | | |
| Run | ** | Plated | Coating Weight | Plated | Coating Weight | Organic Compound added | | wt % |
| No. | PM | Metal | (g/m$^2$) | Metal | (g/m$^2$) | Species | wt % | C |
| THIS INVENTION | | | | | | | | |
| 1 | E | Zn—13% Ni | 30 | Zn—13% Ni | 0.5 | 1-hexyne | 0.5 | 0.001 |
| 2 | | | | | 5.0 | 1-hexyn-3-ol | 0.5 | 0.3 |
| 3 | | | | | 10.0 | laurylamine | 0.5 | 0.5 |
| 4 | | | | | 3.0 | phenylthiourea | 3.0 | 3.0 |
| 5 | | | | | | benzimidazole | 7.0 | 10.0 |
| 6 | | | | | 20.0 | zinc benzoate | 0.5 | 0.01 |
| 7 | | Zn | 60 | Zn | 3.0 | 1-hexyne | 0.5 | 1.0 |
| 8 | | | | | | 1-hexyn-3-ol | 3.0 | 3.0 |
| 9 | | | | | 1.0 | laurylamine | 0.5 | 0.01 |
| 10 | | | | | 5.0 | phenylthiourea | 0.5 | 0.1 |
| 11 | G | | | | | benzimidazole | 0.5 | 0.3 |
| 12 | | | | | 10.0 | zinc benzoate | 0.5 | 0.5 |
| 13 | E | Zn—10% Fe | 45 | Zn—13% Ni | 3.0 | laurylamine | 0.5 | 0.2 |
| 14 | | Zn—5% Sn | 30 | Zn | 5.0 | benzimidazole | 0.5 | 0.1 |
| 15 | | Zn—1% Co | | Zn—13% Ni | | benzimidazole | 0.5 | 0.01 |
| 16 | | Al—28% Mn | 20 | Zn | | zinc benzoate | 0.5 | 0.3 |
| COMP | | | | | | | | |
| 17 | | Zn—13% Ni | 30 | Zn—13% Ni | 5.0 | — | — | —* |
| 18 | | Zn | 60 | Zn | 3.0 | — | — | —* |
| 19 | | Zn—10% Fe | 45 | Zn—13% Ni | | — | — | —* |
| 20 | | Zn—5% Sn | 30 | Zn | 5.0 | — | — | —* |
| 21 | | Zn—1% Co | | Zn—13% Ni | 7.0 | — | — | —* |

TABLE 5-continued

| | | | | | | |
|---|---|---|---|---|---|---|
| 22 | Al—28% Mn | 20 | Zn | — | — | —* |

| Run No. | Post-Painting Corrosion Resistance: Injured Area | Post-Painting Corrosion Resistance: Edge | Press Formability: Workability | Press Formability: Formability | Spot Weldability |
|---|---|---|---|---|---|
| THIS INVENTION | | | | | |
| 1 | ○ | Δ | 5 | ◎ | ◎ |
| 2 | ◎ | ◎ | 5 | ◎ | ◎ |
| 3 | ◎ | ◎ | 5 | ◎ | ◎ |
| 4 | ◎ | ◎ | 5 | ◎ | ◎ |
| 5 | ◎ | ◎ | 5 | ◎ | ◎ |
| 6 | ○ | ○ | 5 | ○ | ◎ |
| 7 | ◎ | ◎ | 5 | ◎ | ◎ |
| 8 | ◎ | ◎ | 5 | ◎ | ◎ |
| 9 | ○ | ○ | 5 | ◎ | ◎ |
| 10 | ◎ | ◎ | 5 | ◎ | ◎ |
| 11 | ◎ | ◎ | 5 | ◎ | ◎ |
| 12 | ◎ | ◎ | 5 | ◎ | ◎ |
| 13 | ◎ | ◎ | 5 | ◎ | ◎ |
| 14 | ◎ | ◎ | 5 | ○ | ◎ |
| 15 | ○ | ○ | 5 | ○ | ◎ |
| 16 | ◎ | ◎ | 5 | ◎ | ◎ |
| COMP | | | | | |
| 17 | × | × | 1 | ◎ | ○ |
| 18 | Δ | Δ | 4 | × | × |
| 19 | Δ | Δ | 1 | ◎ | × |
| 20 | × | × | 1 | × | × |
| 21 | Δ | Δ | 3 | ○ | Δ |
| 22 | Δ | Δ | 3 | ○ | × |

*Outside the range defined herein
**Plating Method: E = Electroplating: G = Galvanizing (hot dipping)

EXAMPLE 4

Following the procedure described in Example 1, a cold-rolled steel sheet was electroplated with a zinc alloy in a sulfate plating solution to which an organic compound had been added to form on each surface a zinc alloy plated coating containing co-deposited carbon.

Figure 2:
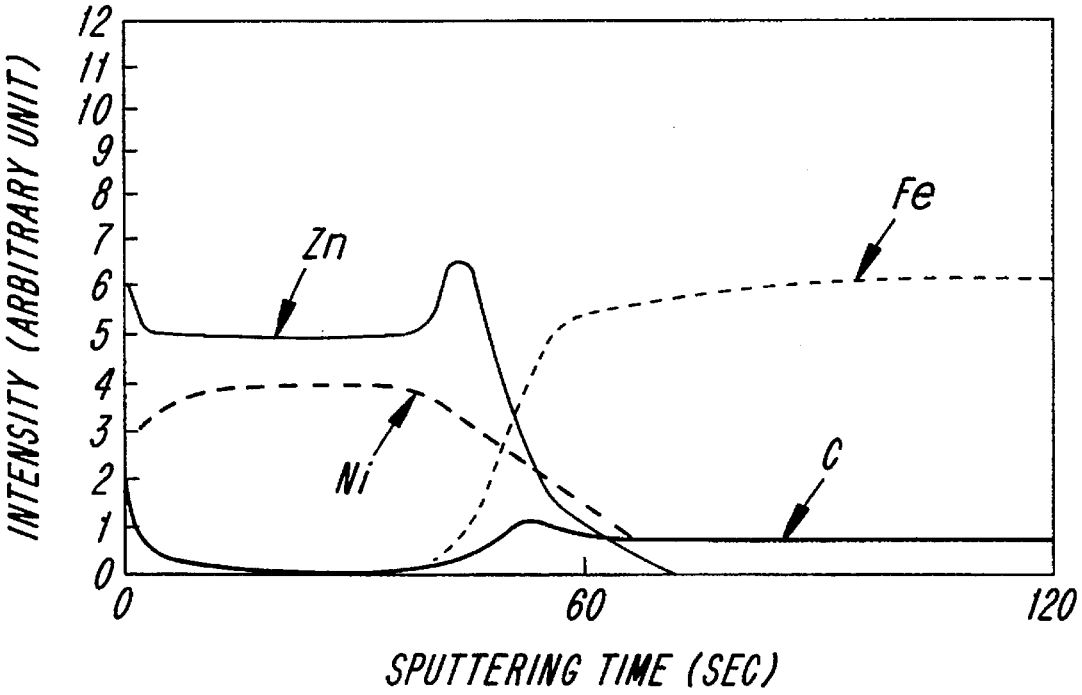
FIG. 2 PRIOR ART
FIG. 2 shows a similar profile across the thickness of a conventional Zn-Ni alloy plated steel sheet.

The profile of the carbon concentration of the plated steel sheet across the thickness was measured by a glow discharge mass spectrometer (Shimadzu GDLS-5017). FIG. 1 shows an example of such a profile of carbon concentration along with the profiles of Fe, Zn, and Ni in a Zn-Ni alloy plated steel sheet according to this invention. For comparison, FIG. 2 shows an example of such profiles for a comparative Zn-Ni alloy plated steel sheet formed by electroplating in a plating solution to which no organic compound was added.

From the profile of carbon concentration, the thickness of a carbon-rich surface layer was determined as an absolute value and as a percentage of the thickness of the zinc alloy plated coating. The results are shown in Table 6 along with the type, coating weight, and carbon content of zinc alloy plated, and the organic compound and amount thereof added to the plating solution.

The zinc alloy-plated steel sheet was further coated with a chromate film with a coating weight of 60 mg/m$^2$ as Cr and a 1.0 μm-thick epoxy resin coating, both of which were formed in the same manner as described in Example 3, to give a composite organic-inorganic coated steel sheet.

The post-painting corrosion resistance, press formability, and spot weldability were tested in the same manner as described in Example 1 except that the results of spot weldability were indicated in terms of the number of welded spots (N) and the difference from the number of welded spots in a corresponding carbon-free zinc alloy coating (Nas), i.e., [N-Nas]. Furthermore, the bare corrosion resistance (to perforation) was evaluated in the manner described below. The test results are also shown in Table 6.

Bare Corrosion Resistance

An intact test specimen measuring 70 mm×150 mm was subjected to the same accelerated cyclic corrosion test as described for the testing procedure of post-painting corrosion resistance in Example 1. After 300 cycles, the corrosion product formed on the specimen was removed and the maximum depth of perforations (D) caused by corrosion was measured, and the bare corrosion resistance was evaluated as follows.

O: D<0.2 mm

Δ: 0.2 mm≦D≦0.6 mm

X: D>0.6 mm

TABLE 6

| Run No. | Composition of Plated Coating: Plated Metal | Coating Weight (g/m²) | Organic Compound Added to Plating Bath: Species | wt % | C-Rich Surface Layer in Coating: wt % C | μm | % | BCR[1] | Press[2] Formability: W | F | Post-painting Corrosion Resistance: Injured Area | Edge | Spot Weldability: N | N-Nas[3] |
|---|---|---|---|---|---|---|---|---|---|---|---|---|---|---|
| THIN-VETON | | | | | | | | | | | | | | |
| 1 | Zn—13% Ni | 20 | 1-hexyne | 5 | 0.03 | 0.28 | 10 | ○ | 5 | ◎ | ◎ | ◎ | 9500 | 4000 |
| 2 | | 20 | 1-hexyn-3-ol | 1 | 0.21 | 0.50 | 18 | ○ | 5 | ◎ | ◎ | ◎ | 9000 | 3500 |
| 3 | | 30 | laurylamine | 3 | 0.65 | 1.05 | 25 | ○ | 5 | ◎ | ◎ | ◎ | 8500 | 3500 |
| 4 | | 30 | phenylthiourea | 1 | 0.52 | 0.67 | 16 | ○ | 5 | ◎ | ◎ | ◎ | 8800 | 3800 |
| 5 | | 30 | benzimidazole | 5 | 0.81 | 1.68 | 40 | ○ | 5 | ◎ | ◎ | ◎ | 8000 | 3000 |
| 6 | | 40 | zinc benzoate | 3 | 0.55 | 1.46 | 26 | ○ | 5 | ◎ | ◎ | ◎ | 7200 | 2700 |
| 7 | Zn—11% Fe | 40 | 1-hexyne | 3 | 1.31 | 1.57 | 28 | ○ | 5 | ◎ | ◎ | ◎ | 6600 | 3000 |
| 8 | | 40 | 1-hexyn-3-ol | 5 | 1.81 | 2.13 | 38 | ○ | 5 | ◎ | ◎ | ◎ | 5900 | 2300 |
| 9 | | 80 | laurylamine | 0.2 | 0.01 | 02.8 | 10 | ○ | 5 | ◎ | ◎ | ◎ | 5800 | 2800 |
| 10 | | 80 | phenylthiourea | 4 | 2.87 | 3.92 | 35 | ○ | 5 | ◎ | ◎ | ◎ | 5500 | 2500 |
| 11 | | 120 | benzimidazole | 2 | 2.01 | 3.53 | 21 | ○ | 5 | ◎ | ◎ | ◎ | 5600 | 2800 |
| 12 | | 160 | zinc benzoate | 5 | 4.25 | 5.15 | 23 | ○ | 5 | ◎ | ◎ | ◎ | 4900 | 2400 |
| 13 | Zn—18% Fe | 50 | benzotriazole | 3 | 0.81 | 1.96 | 28 | ○ | 5 | ◎ | ◎ | ◎ | 7500 | 3000 |
| 14 | Zn—13% Ni | 30 | zinc benzoate | 3 | 0.98 | 0.84 | 20 | ○ | 5 | ◎ | ◎ | ◎ | 9000 | 3500 |
| 15 | | 30 | benzotriazole | 3 | 1.35 | 1.05 | 25 | ○ | 5 | ◎ | ◎ | ◎ | 10500 | 5500 |
| COM-PAR | | | | | | | | | | | | | | |
| 16 | Zn—13% Ni | 30 | — | — | —* | —* | —* | ○ | 2 | ◎ | ×× | ×× | 5000 | 0 |
| 17 | Zn | 120 | — | — | —* | —* | —* | Δ | 4 | × | × | × | 2800 | 0 |
| 18 | Zn—18% Fe | 50 | — | — | —* | —* | —* | Δ | 2 | ◎ | × | × | 4500 | 0 |
| 19 | Zn—1% Co | 30 | — | — | —* | —* | —* | Δ | 2 | × | × | × | 3500 | 0 |
| 20 | Zn—13% Ni | 30 | — | — | —* | —* | —* | ○ | 2 | × | ×× | ×× | 5500 | 0 |
| 21 | | 30 | 1-hexyne | 0.0005* | 0.003 | 0.08* | 2* | ○ | 2 | × | ×× | ×× | 5000 | 0 |
| 22 | | 30 | 1-hexyne | 12* | 10.1* | 2.52 | 60* | ○ | 2 | ◎ | ×× | ×× | 5200 | 200 |

*Outside the range defined herein
[1]BCR = Bared Corrosion Resistance;
[2]W = Workability, F = Formability
[3]Nas = Number of weldable spots in corresponding conventional carbon-free zinc-alloy plated steel.

As can be seen from Table 6, each zinc alloy plated coating formed from a plating solution containing 0.001–10 wt % of an organic compound had a carbon-rich surface layer having a thickness in the range of 0.1–10 μm and constituting 5%–50% of the thickness of the plated coating. Furthermore, they exhibited improved press formability, corrosion resistance before and after painting, and spot weldability. Particularly, they were significantly improved in spot weldability over corresponding carbon-free zinc alloy plated steel sheet as indicated by the values for [N-Nas].

EXAMPLE 5

Following the procedure described in Example 1, a cold-rolled steel sheet was electroplated with a zinc alloy in a sulfate plating solution to which an organic compound had been added to form a zinc alloy plated coating containing co-deposited carbon and not greater than 10 wt % of alloying metal element(s) on each surface.

The thickness of the carbon-rich surface layer formed in the plated coating was determined in the same manner as described in Example 4 as an absolute value and as a percentage of the plated coating.

The orientation indices of the (00·2) plane and the (10·1) plane of η-phase present in the composite zinc alloy coating were determined by X-ray diffractometry in the above-described manner using a high-voltage X-ray diffraction apparatus equipped with a cobalt target.

The results of these measurements are shown in Table 7 along with the type, coating weight, and carbon content of zinc alloy plated, and the organic compound and amount thereof added to the plating solution.

The press formability and post-painting corrosion resistance of each plated steel sheet were evaluated in the same manner as described in Example 1.

The spot weldability and low-temperature impact resistance were evaluated in the following manner. These test results are also shown in Table 7.

Spot Weldability

Two test specimens of the plated steel sheet obtained in each run were welded by continuous spot welding using a single-phase AC spot welder under the following conditions, which were more severe than those employed in Example 1.

Current passed: 27,000 A

Welding force: 300 kgf

Weld time: 6 cycles (at 60 Hz)

Shape of electrodes: Dome shape

The welding method was the same as described in Example 1. The spot weldability was evaluated by the number of welded spots (N) before the nugget diameter decreased to 3.6 mm or smaller as follows:

◎: N≧2000

O: 2000>N≧1500

Δ: 1500>N≧1000

X: N<1000

Low-Temperature Impact Resistance

An intact test specimen was painted by the same process as described in Example 1. A diamond grain having a diameter of about 3 mm was hit at a speed of 120 km/hour against the painted test specimen at ten different points at −40° C. The painted test piece after hitting was exposed to an outdoor environment in an industrial area in Japan for 5 years while it was immersed in a 3% NaCl solution for 30 minutes once a month. After this exposure test, the maximum diameter of blisters (B) observed at the points where the test specimen was hit was measured and the low-temperature impact resistance was evaluated as follows.

⊚: B<1 mm

O: 1 mm≦B<3 mm

Δ: 3 mm≦B<5 mm

X: B≧5 mm

As can be seen from Table 7, each composite zinc alloy plated coating formed in accordance with this invention and containing not greater than 10% of alloying element(s) had an η-phase in the alloy microstructure, in addition to a carbon-rich surface layer, and the orientation index was not greater than 0.8 for the (00·2) plane and not less than 0.2 for the (10·1) plane. As a result, not only the press formability, spot weldability, and post-painting corrosion resistance, but also the low-temperature impact resistance were improved.

It will be appreciated by those skilled in the art that numerous variations and modifications may be made to the invention as described above with respect to specific embodiments without departing from the spirit or scope of the invention as broadly described.

TABLE 7

| Run No. | Composition of Plated Coating: Plated Metal | Coating Weight (g/m²) | Organic Compound Added to Plating Bath: Species | wt % | wt % C | C-Rich Surface Layer in Coating: μm | % |
|---|---|---|---|---|---|---|---|
| THIS INVENTION | | | | | | | |
| 1 | Co: 0.9% | 20 | 1-hexyne | 0.05 | 0.02 | 0.21 | 7.5 |
| 2 | " | 20 | 1-hexyn-3-ol | 1 | 0.23 | 0.50 | 18 |
| 3 | " | 30 | phenylthiourea | 0.5 | 0.65 | 1.05 | 25 |
| 4 | " | 30 | benzimidazole | 5 | 0.81 | 1.68 | 40 |
| 5 | Co: 1.2% Ni: 6% | 40 | zinc benzoate | 3 | 0.55 | 1.46 | 26 |
| 6 | " | 40 | benzotriazole | 10 | 0.32 | 2.8 | 50 |
| 7 | " | 40 | 1-hexyn-3-ol | 5 | 1.81 | 2.13 | 38 |
| 8 | " | 80 | laurylamine | 3 | 1.54 | 2.24 | 20 |
| 9 | Co: 3.1% Fe: 4% | 80 | phenylthiourea | 4 | 2.87 | 3.92 | 35 |
| 10 | " | 120 | benzimidazole | 2 | 2.01 | 3.53 | 21 |
| 11 | " | 160 | zinc benzoate | 5 | 4.25 | 5.15 | 23 |
| 12 | " | 200 | benzotriazole | 2 | 7.01 | 6.16 | 22 |
| 13 | Ni: 6.3% | 50 | phenylthiourea | 3 | 0.81 | 1.96 | 28 |
| 14 | Ni: 3% Fe: 4.2% | 60 | benzimidazole | 3 | 2.56 | 2.02 | 24 |
| 15 | " | 60 | dimethyl sulfide | 3 | 2.11 | 2.27 | 27 |
| 16 | Co: 1% Ni: 2.5% Fe: 5% | 40 | benzimidazole | 3 | 1.32 | 1.40 | 25 |
| 17 | Co: 1% Ni: 2.5% Fe: 5% | 30 | zinc benzoate | 3 | 0.98 | 0.84 | 20 |
| 18 | Co: 1% Ni: 2.5% Fe: 5% | 30 | propenylamine | 3 | 1.35 | 1.05 | 25 |
| 19 | Co: 1% | 40 | benzimidazole | 3 | 1.32 | 1.40 | 25 |
| COMP | | | | | | | |
| 20 | Co: 0.9% | 20 | benzimidazole | 0.001 | 0.008* | 0.1 | 4* |
| 21 | " | 20 | " | 10 | 12.3* | 1.4 | 50 |
| 22 | " | 3* | " | 2 | 0.08 | 0.1 | 25 |
| 23 | " | 250* | " | 6 | 6.5 | 3.5 | 10 |

| Run No. | Orientation index of η-phase: (00.2) Plane | (10.1) Plane | BCR[1)] | Press[2)] Formability: W | F | Post-painting Corrosion Resistance: Injured Area | Edge | Spot Weldability | Low-Temp. Impact Resistance |
|---|---|---|---|---|---|---|---|---|---|
| THIS INVENTION | | | | | | | | | |
| 1 | 0.51 | 0.31 | ○ | 5 | ○ | ⊚ | ⊚ | ⊚ | ⊚ |
| 2 | 0.32 | 0.26 | ○ | 5 | ⊚ | ⊚ | ⊚ | ⊚ | ⊚ |
| 3 | 0.63 | 0.33 | ○ | 5 | ⊚ | ⊚ | ⊚ | ⊚ | ⊚ |

TABLE 7-continued

| | | | | | | | | | |
|---|---|---|---|---|---|---|---|---|---|
| 4 | 0.25 | 0.29 | ○ | 5 | ◎ | ◎ | ◎ | ◎ | ◎ |
| 5 | 0.77 | 0.27 | ○ | 5 | ◎ | ◎ | ◎ | ◎ | ◎ |
| 6 | 0.66 | 0.41 | ○ | 5 | ◎ | ◎ | ◎ | ◎ | ◎ |
| 7 | 0.48 | 0.25 | ○ | 5 | ◎ | ◎ | ◎ | ◎ | ◎ |
| 8 | 0.75 | 0.33 | ○ | 5 | ◎ | ◎ | ◎ | ◎ | ◎ |
| 9 | 0.62 | 0.29 | ○ | 5 | ◎ | ◎ | ◎ | ◎ | ◎ |
| 10 | 0.51 | 0.31 | ○ | 5 | ◎ | ◎ | ◎ | ◎ | ◎ |
| 11 | 0.44 | 0.28 | ○ | 5 | ◎ | ◎ | ◎ | ◎ | ◎ |
| 12 | 0.58 | 0.36 | ○ | 5 | ◎ | ◎ | ◎ | ◎ | ◎ |
| 13 | 0.61 | 0.37 | ○ | 5 | ◎ | ◎ | ◎ | ◎ | ◎ |
| 14 | 0.78 | 0.29 | ○ | 5 | ◎ | ◎ | ◎ | ◎ | ◎ |
| 15 | 0.74 | 0.31 | ○ | 5 | ◎ | ◎ | ◎ | ◎ | ◎ |
| 16 | 0.31 | 0.24 | ○ | 5 | ◎ | ◎ | ◎ | ◎ | ◎ |
| 17 | 0.63 | 0.33 | ○ | 5 | ◎ | ◎ | ◎ | ◎ | ◎ |
| 18 | 0.54 | 0.27 | ○ | 5 | ◎ | ◎ | ◎ | ◎ | ◎ |
| 19 | 0.61 | 0.36 | ○ | 5 | ◎ | ◎ | ◎ | ◎ | ◎ |
| COMP | | | | | | | | | |
| 20 | 0.72 | 0.23 | × | 3 | × | × | × | × | × |
| 21 | 0.61 | 0.21 | × | 3 | ○ | × | × | Δ | ○ |
| 22 | 0.65 | 0.33 | × | 3 | × | × | × | × | ○ |
| 23 | 0.71 | 0.26 | × | 2 | ○ | ○ | ○ | × | ○ |

*Outside the range defined herein
[1)]BCR = Bared Corrosion Resistance;
[2)]W = Workability, F = Formability

What is claimed is:

1. A method for producing a composite zinc or zinc alloy electroplated metal sheet comprising subjecting a metal sheet to electroplating with zinc or a zinc alloy in a plating solution which contains at least one organic compound selected from the group consisting of alkynes, alkynols, amines and salts thereof, thio compounds, heterocyclic compounds, and aromatic carboxylic acids and salts thereof in an amount in the range of 0.001–10 wt % to form, on at least one surface of the metal sheet, a composite zinc or zinc alloy plated coating having a coating weight of 0.5–200 g/m$^2$ and containing 0.001–10 wt % of co-deposited carbon, the composite zinc alloy plated coating having a carbon-rich surface layer wherein the carbon content is higher than the rest of the plating, the electroplating being performed by using a pulse current having an off-time of 1 msec to 1 second and a duty factor of at least 0.5 or a superimposed AC current having a frequency of 1–100 Hz and a current variation peak of ±1% to ±50%.

2. The method of claim 1, wherein the zinc alloy is an alloy of Zn with one or more alloying metal elements selected from the group consisting of Fe, Ni, Co, Mn, Cr, and Sn.

3. The method of claim 2, wherein the alloying metal element or elements are selected from the group consisting of Fe, Ni, and Co.

4. The method of claim 1, wherein the organic compound is present in the plating solution in an amount of 0.05–10 wt %.

5. The method of claim 4, wherein the amount of the organic compound is 0.1–10 wt % for alkynes and alkynols, 3–10 wt % for amines, 0.2–5 wt % for thio compounds, 1.5–10 wt % for heterocyclic compounds, and 3–8 wt % for aromatic carboxylic acids.

6. An electroplated metal plate which comprises a metal sheet having, on at least one surface thereof, a composite zinc or zinc alloy plated coating having a coating weight of 0.5–200 g/m$^2$ and containing 0.001–10 wt % of co-deposited carbon and up to 10 wt % in total of one or more alloying metal elements, the composite zinc alloy plated coating having a carbon-rich surface layer wherein the carbon content is higher than the rest of the plating, and the η phase present in the composite zinc alloy plated coating has an orientation index of not greater than 0.8 for the (00·2) plane and not less than 0.2 for the (10·1) plane.

7. The electroplated metal sheet of claim 6, wherein the metal sheet is a steel sheet and the composite zinc or zinc alloy plated coating has a weight of 5–200 g/m$^2$.

8. The electroplated metal sheet of claim 6, wherein the metal sheet is a plated steel sheet having a plated coating selected from the group consisting of a zinc coating, an aluminum coating, and a zinc or aluminum alloy coating, on which the composite plated coating is formed with a weight of 0.5–20 g/m$^2$.

9. The electroplated metal sheet of claim 6, wherein the composite zinc or zinc alloy plated coating contains 0.05–5 wt % of co-deposited carbon.

10. The electroplated metal sheet of claim 9, wherein the composite zinc or zinc alloy plated coating contains 0.5–3 wt % of co-deposited carbon.

11. A composite organic-inorganic coated metal sheet comprising the composite zinc or zinc alloy electroplated metal sheet of claim 6, a chromate film formed with a weight of 10–200 mg/m$^2$ as Cr on the composite zinc or zinc alloy plated coating of the metal sheet, and an organic resin coating formed with a thickness of 0.1–2 μm on the chromate film.

12. The composite organic-inorganic coated metal sheet of claim 11, wherein the organic resin is an epoxy resin.

13. The electroplated metal sheet of claim 6, wherein the carbon-rich surface layer has a thickness of 0.1–5 μm.

14. The electroplated metal sheet of claim 6, wherein the composite zinc alloy plated coating is electroplated using a pulsed DC current or current having an off-time of 1 msec to 1 second and a duty factor of at least 0.5 or using an superimposed AC current having a frequency of 1–100 Hz and a current variation peak of ±1% to ±50%.

15. A composite zinc alloy electroplated metal sheet comprising a metal sheet having, on at least one surface thereof, a composite zinc alloy plated coating having a coating weight of 0.5–200 g/m$^2$ and containing 0.001–10 wt % of co-deposited carbon and including 0.4 to 2 % Co, wherein the composite zinc alloy plated coating has a carbon-rich surface layer with a thickness of 0.1–10 μm, said thickness constituting from 5 % to 50% of the thickness of the plated coating, and the carbon-rich surface layer having a carbon content higher than the rest of the plating.

16. The composite zinc alloy electroplated metal sheet of claim 15, wherein the composite zinc alloy plated coating further includes Fe, Ni or mixture thereof.

17. The composite zinc alloy electroplated metal sheet of claim 15, wherein the thickness of the carbon-rich surface layer is 0.1–5 μm and constitutes from 5 % to 40% of the thickness of the plated coating, and the carbon content in the carbon-rich surface is at least two times the mean carbon concentration of the plated coating.

18. A composite organic-inorganic coated metal sheet comprising the composite zinc alloy electroplated metal sheet of claim 15, a chromate film formed with a weight of 10–200 mg/m$^2$ as Cr on the composite zinc alloy plated coating of the metal sheet, and an organic resin coating formed with a thickness of 0.1–2 μm on the chromate film.

19. The electroplated metal sheet of claim 15, wherein the composite zinc alloy plated coating is electroplated using a pulsed DC current or current having an off-time of 1 msec to 1 second and a duty factor of at least 0.5 superimposed or using an AC current having a frequency of 1–100 Hz and a current variation peak of ±1% to ±50%.

20. A composite zinc alloy electroplated metal sheet comprising a metal sheet having, on at least one surface thereof, a composite zinc alloy plated coating having a coating weight of 0.5–200 g/m$^2$ and containing 0.001–10 wt % of co-deposited carbon and 0.2–10 wt % in total of one or more alloying metal elements, wherein the η phase present in the composite zinc alloy plated coating has an orientation index of not greater than 0.8 for the (00·2) plane and not less than 0.2 for the (10·1) plane, and the carbon-rich surface layer having a carbon content higher than the rest of the plating.

21. The composite zinc alloy electroplated metal sheet of claim 20, wherein the one or more alloying metal element are selected from Fe, Co, and Ni.

22. The composite zinc alloy electroplated metal sheet of claim 20, wherein the η phase has an orientation index of not greater than 0.7 for the (00·2) plane and not less than 0.25 for the (10·1) plane.

23. A composite organic-inorganic coated metal sheet comprising the composite zinc alloy electroplated metal sheet of claim 20, a chromate film formed with a weight of 10–200 mg/m$^2$ as Cr on the composite zinc alloy plated coating of the metal sheet, and an organic resin coating formed with a thickness of 0.1–2 μm on the chromate film.

24. The composite zinc alloy electroplated metal sheet of claim 20, wherein the carbon-rich surface layer has a thickness of 0.1–5 μm.

* * * * *